United States Patent [19]

Klawe

[11] Patent Number: 4,928,339

[45] Date of Patent: May 29, 1990

[54] POT-TYPE BEARING FOR CONSTRUCTIONS SUCH AS BRIDGES OR THE LIKE

[75] Inventor: Ernst Klawe, Erding, Fed. Rep. of Germany

[73] Assignee: Friedrich Maurer Söhne GmbH & Co. KG, Munich, Fed. Rep. of Germany

[21] Appl. No.: 303,330

[22] Filed: Jan. 30, 1989

[30] Foreign Application Priority Data

Jan. 29, 1988 [DE] Fed. Rep. of Germany ..... 3802580

[51] Int. Cl.[5] ..... E01D 19/06; F16C 27/06

[52] U.S. Cl. ..... 14/16.1; 248/633; 277/227; 384/36; 384/37; 384/42

[58] Field of Search ..... 14/16.1; 384/36, 7, 384/15, 37, 42; 52/167, 573; 277/12, 227; 248/632–634

[56] References Cited

U.S. PATENT DOCUMENTS

| | | | |
|---|---|---|---|
| 3,508,797 | 4/1970 | Marsh | 384/36 |
| 3,728,752 | 4/1973 | Andra et al. | 14/16.1 |
| 3,782,789 | 1/1974 | Koester et al. | 14/16.1 |
| 3,934,295 | 1/1976 | Koster et al. | 14/16.1 |
| 3,995,915 | 12/1976 | Koster et al. | 14/16.1 |
| 3,998,499 | 12/1976 | Chiarotto | 384/36 |
| 4,006,505 | 2/1977 | Koster et al. | 14/16.1 |
| 4,172,600 | 10/1979 | Koster et al. | 14/16.1 |
| 4,200,341 | 4/1980 | Kauschke | 384/15 |

FOREIGN PATENT DOCUMENTS

| | | | |
|---|---|---|---|
| 0243304 | 11/1965 | Austria | 14/16.1 |
| 1202813 | 10/1965 | Fed. Rep. of Germany | 14/16.1 |
| 2063746 | 7/1972 | Fed. Rep. of Germany | 14/16.1 |
| 0095704 | 7/1980 | Japan | 14/16.1 |
| 0612993 | 6/1978 | U.S.S.R. | 14/16.1 |

*Primary Examiner*—Bruce M. Kisliuk

*Attorney, Agent, or Firm*—Kline, Rommel & Colbert

[57] ABSTRACT

The width of a pot bearing seal (8) is restricted to a minimum in such manner that it seals off the gap (18) between the internal pot wall (16) of a bearing pot (2) and a bearing cap (4) of a pot bearing (14) while providing a minimum overlapping between the pot bearing seal (8) and the bearing cap (4), whereas the height of the pot bearing seal (8) is such that the cylindrical surfaces (22) of the pot bearing seal (8) abuts the internal pot wall (16) even when the bearing cap (4) is inclined with respect to the horizontal line. Hereby the wear of the pot bearing seal is considerably reduced.

12 Claims, 3 Drawing Sheets

POT-TYPE BEARING FOR CONSTRUCTIONS SUCH AS BRIDGES OR THE LIKE

Figure 1:
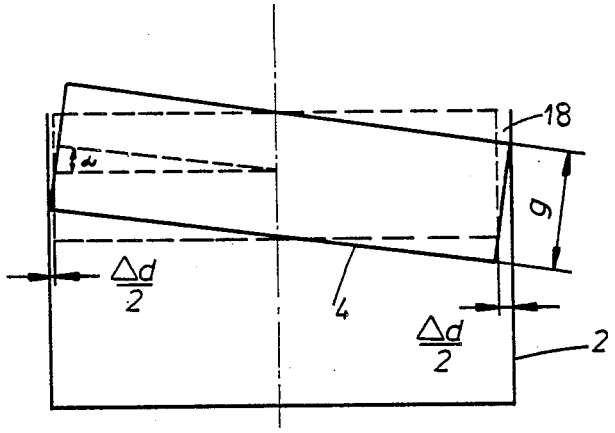

The present invention relates to a pot bearing for constructions such as bridges and the like, comprising a bearing pot, a flexible pressure pad arranged inside the bearing pot, a bearing cap which engages the inside of the bearing pot and is supported on the pressure pad, as well as an annular pot bearing seal which seals off the gap between the cylindrical internal pot wall and the bearing cap.

Pot bearing seals commonly used hitherto are brass rings of rectangular cross-section having cross-sectional dimensions such as e.g. a height of 2 mm and a width of 6 mm. The width of the sealing ring in such known pot bearing seals is selected comparatively large, in order to ensure that under the influence of the pressure prevailing in the pressure pad the pot bearing seal is pressed upward against the bearing cap so that its surface sits close to the same. When the bearing cap is tilted about a hoirzontal axis which may lie either in the plane of the bearing cap or also above or below the plane of the bearing cap, depending on the geometry of the bridge superstructure, then not only the bearing cap but at the same time also the originally horizontal plane of the pot bearing seal takes an inclined position. Thus, when the bearing cap is tilted, then also the cylindrical surface of the pot bearing seal takes an inclined position with respect to the internal pot wall. The generatrices of the cylindrical surface of the pot bearing seal and the vertically extending generatrices of the cylindrical internal pot wall define an acute angle. As a result, the pot bearing seal and the internal pot wall have no surface contact, but only a line contact. Such a line contact between the pot bearing seal and the bearing pot, however, does not always provide for a sufficiently reliable sealing between these two components and causes a high wear of the pot bearing seal.

It also happened that two pot bearing seals of the type described above were inserted one over another in order to improve the sealing. In case of tilting of the bearing cap the two pot bearing seals, which are designed as brass rings, should shift with respect to each other in a radial direction, whereby a close surface contact of the two brass rings with the internal pot wall should be obtained. However, in practice also such arrangement proved to be not sufficiently reliable.

It is therefore the object of the present invention to provide a bearing seal for a pot bearing of the kind described above, which has not only a simple structure but also improved reliability as compared with the known prior art.

This object is basically achieved by restricting the width of the pot bearing seal to a minimum in such manner that it seals off a maximum gap between the internal pot wall and the bearing cap while providing a minimum overlapping between the pot bearing seal and the bearing cap, and that the height of the pot bearing seal is such that the cylindrical surface of the pot bearing seal sits close to the internal pot wall even when the bearing cap is inclined with respect to the horizontal line.

Thus, in the case of the present invention the width of the pot bearing seal is limited to the minimum required for sealing off the gap between the internal pot wall and the bearing cap, and simultaneously the height of the pot bearing seal is increased in comparison to the prior art. This leads to the result that due to the internal pressure of the pressure pad the area of the cylindrical surface of the pot bearing seal is pressed against the internal wall of the bearing pot even when the bearing cap is tilted with respect to the horizontal line or with respect to the plane which is perpendicular to the cylindrical axis of the bearing pot.

Thus, in the case of the present inventon there is always a surface contact between the internal pot wall and the cylindrical surface of the pot bearing seal, which, as compared to the prior art, allows a substantially less wearaffected transfer of the contact forces caused by the internal pressure of the pressure pad, thus drastically reduces the wear of the pot bearing seal, and finally clearly improves the reliability of the seal.

The width of the pot bearing seal must be selected at least such that the pot bearing seal covers the maximum possible gap between the internal pot wall and the bearing cap. In order to allow a tilting of the bearing cap in the cylindrical bearing pot, a minimum play of $\Delta d = g \times \sin \alpha$ must be kept, in which $\Delta d$ corresponds to the difference between the inner diameter of the internal pot wall and the outer diameter of the bearing cap, g is the height of the cylindrical bearing cap or of that part of the cylindrical bearing cap which projects into the bearing pot, and $\alpha$ is the maximum-occuring tilt angle. Of course, also an inevitable manufacturing tolerance must be taken account of. Thus, the minimum play between the bearing cap and the internal pot wall may be in a range of about 0.8 and 1 mm. The width of the pot bearing seal must have a minimum overlapping in order to bridge over the maximum possible play, so that as a result in practice the minimum width of the sealing ring will be about 1.5 mm.

In a preferred development of the invention the minimum overlapping is therefore less than 2 mm.

The width of the sealing play between the internal pot wall and the cylindrical outer surface of the bearing cap should be kept as small as possible, and according to the above formula in a preferred development of the invention it may be in a range of about 0.5 to 1.5 mm, preferably 0.8 to 1 mm.

The width of the pot bearing seal according to the invention can therefore be generally smaller than 3 mm. Due to this small width of the pot bearing seal, the bearing cap may be tilted at an angle such that portions of the bottom thereof no longer abut against and are spaced apart from the top of the seal, as diagrammatically shown in FIG. 1.

In order to ensure that the pot bearing seal of the present invention is pressed outward against the internal pot wall with a sufficient force and that it remains in parallel alignment to the central vertical axis of the bearing pot axis even when the bearing cap is tilted, the height of the pot bearing seal should be, in a preferred development of the invention, at least three times as large as the width thereof. Preferably the height of the pot bearing seal is in a range between 9 and 15 mm.

For optimum operation of the pot bearing seal, particularly also in view of reducing wear to a minimum, the cylindrical surface of the pot bearing seal, which is in surface contact with the internal pot wall, should have good antifriction (sliding) properties, high wear resistance and high rigidity against contact pressures. In a particular advantageous embodiment of the invention the pot bearing seal is therefore provided with a bearing foil on its outer cylindrical surface. Such well-known bearing foils exhibit the abovementioned properties to a high extent. The bearing foil may be particularly of reinforced anti-wear PTFE. For reinforcing the PTFE material, a metal wire cloth is particularly suitable. Such bearing foils, in which in a special process a metal wire cloth has been sintered into a PTFE foil, are commercially available for instance under the trade name "Pampus Metalloplast". Such bearing foils exhibit very good antifriction properties without any foreign lubrication being required.

In an alternative embodiment of the present invention, also carbon- or glassfiber reinforced PTFE foils may be used instead of metal wire cloth reinfooned PTFE foils.

When the bearing cap is tilted about a horizontal axis, different angles occur between the plane defined by the underside of the bearing cap and the perpendicular tangential plane applied to any surface line of the pot wall cylinder along the circumference of the internal pot wall. In order to enable the pot bearing seal to adjust itself to such angle which is variable along the periphery of the bearing cap, a comparatively small torsional rigidity of the pot bearing seal is desirable. The small design of the pot bearing seal according to the invention ensures a comparatively small torsional rigidity.

Most relevant for selecting the material of the pot bearing seal are a high rigidity required for closing off the play of the cap, and particularly also the take-up of high contact pressures with the least possible deformations. The pot bearing seal may be particularly of corrosion-resistant metal such as particularly high-grade steel and may be bent of flat material. The required antifriction properties of such pot bearing seal are obtained particularly due to the above mentioned bearing foil. Due to the small thickness of the flat material of e.g. 3 mm, the desired low torsional rigidity of the pot bearing seal, which allows for adjustment to the different angles between the bearing cap and the internal pot wall, can be ensured.

In a particularly advantageous development of the invention provision is made that the annular pot bearing seal comprises a sequence of tandem-joined upright metal laminas which are joined to each other by means of rubber layers vulcanized in between the laminas. Due to the rubber layers vulcanized in between the single metal laminas, a particularly high flexibility and torsibility of the single laminas against each other will be obtained, whereby also a particularly low torsional rigidity of the pot bearing seal is achieved.

The method of manufacturing such pot bearing seals consisting of laminas is characterized according to the invention in that parallel spaced steel plates are vulcanized in an elastomer block, and that the pot bearing seals are cut out of said block by appropriate cuts extending perpendicularly to the plane of the steel plates. The pot bearing seals cut out of the elastomer-metal-block in the required size are then formed to a ring by putting their two opposing ends together, and are then preferably loosely inserted into a groove along the circumference of the pressure pad. The pressure pad can be produced in a simple manner by cutting it out in an appropriate size of a rubber plate, and subsequently only the groove for receiving the pot bearing seal must be made.

Figure 2:
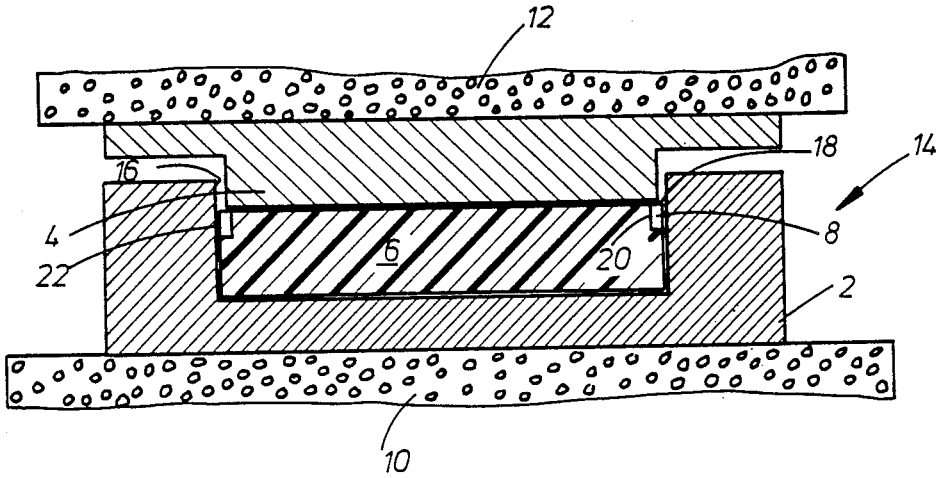
Figure 3:
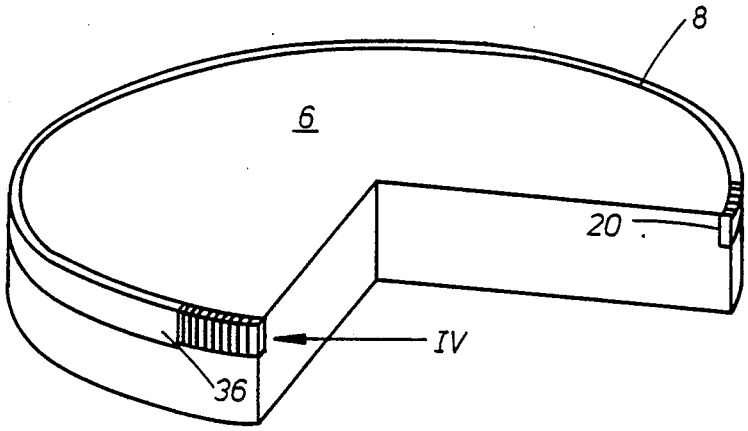
Figure 4:
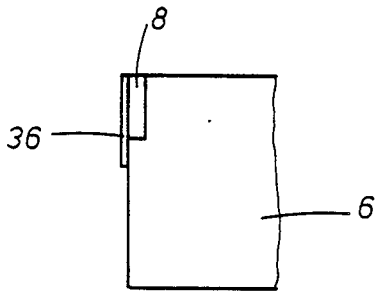
Figure 5:
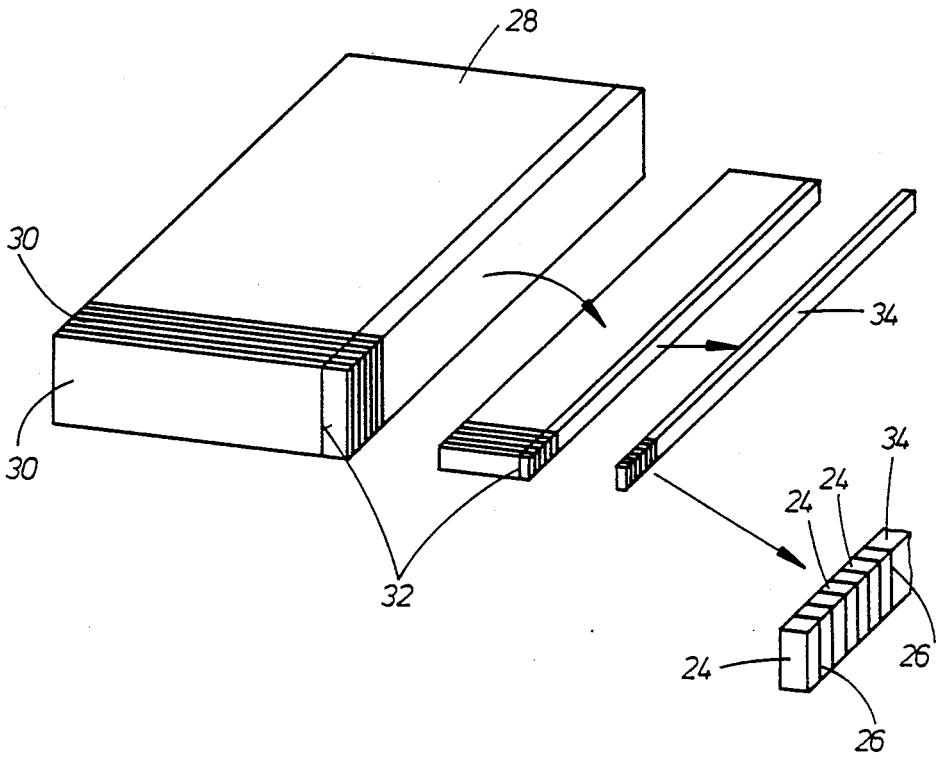

An embodiment of the invention is explained hereinafter in detail, reference being had to the accompanying drawing in which semischematically or schematically FIG. 1 is an outline of a bearing pot and of a bearing cap arranged in the pot in a tilted position, to illustrate the calculation of the play required between the bearing pot and the bearing cap, FIG. 2 is a section through a pot bearing according to the invention, FIG. 3 is a perspective view of a pressure pad of the pot bearing according to FIG. 2, including the pot bearing seal which is held on the pressure pad, FIG. 4 is a plan view of a section through the bearing cap and the pot bearing seal according to FIG. 3 in the direction of arrow IV, and FIG. 5 shows the preferred method for manufacturing the pot bearing seal according to FIG. 3.

FIG. 2 shows a section of the basic structure of a pot bearing, in which the dimensions of the single parts may be overstated or understated for illustration purposes. In FIG. 2 reference numeral 10 designates a lower building portion which is associated with an upper building portion 12 via a pot bearing designated as a whole with reference numeral 14. The pot bearing 14 comprises a bearing pot 2, an elastically deformable pressure pad 6 arranged in said bearing pot 2, as well as a bearing cap 4, upon which the upper building portion 12 is supported, and which projects into the interior of the bearing pot 2 and rests on the pressure pad 6. For sealing off the gap 18 defined between the bearing cap 4 and the internal pot wall 16 provision is made for an annular pot bearing seal 8 which is disposed in a circumferential groove 20 extending along the upper outer edge of the pressure pad 6.

FIG. 1 shows the relation between the width of the gap 18, the effective height g of that portion of the bearing cap 4 which projects into the bearing pot 2, and the tilt angle $\alpha$ taken in respect of the horizontal line by a tilted bearing cap 4.

The height of the cylindrical edge of the bearing pot 4 required for transferring horizontal forces between the bearing cap and the pot wall results from the admissible hertzian pressure and may reach values from 10 to 12 mm. In order to allow squeeze-free tilting in case of a cylindrical edge, a minimum play between the bearing cap 4 and the bearing pot 2 of $\Delta d = g \times \sin \alpha$ must be kept, g being the height of the cylindrical cap edge to be considered. On the other hand the play $\Delta d$ between the bearing cap and the bearing pot must be limited in the upward direction in order to prevent the pot bearing seal from possibly moving into the gap 18. When the diameter of the pot bearing is 600 mm, a play d of 0.8 mm is selected.

Between the plane defined by the underside of the bearing cap and the perpendicular tangential plane applied to any surface line of the pot wall cylinder an angle $\delta$ will occur. When the bearing cap is in a horizontal position, said angle $\delta$ is 90° over the entire circumference of the pot bearing seal. However, when the bearing cap is tilted about an axis lying in the plane of the cap underside, the angle $\delta$ varies along the circumference of the internal pot wall. The inclined plane of the cap underside intersects the cylindrical internal pot wall 16 along an ellipse, in which the tilt axis defines the small principal axis, and the straight line extending perpendicularly to the tilt axis defines the large principal axis of the ellipse. When the end points of the large principal axis are designated as A and B, and the end points of the small principal axis as C and D, then a tilting of the bearing cap about the angle $\delta$ results e.g. in an angle of $\delta \leqq 90°$ at A, of $\delta \geqq 90°$ at B, and of $\delta = 90°$ at C and D. Thus, angle $\delta$ varies permanently.

In order to fulfill the sealing function, the bearing cap must overlap the pot bearing seal. As a result, the upper surface of the pot bearing seal lies in the plane of the cap underside. The lateral face of the pot bearing seal shall abut the internal pot wall 16. Consequently, the angle between the upper surface and the lateral surface of the pot bearing seal should also adjust itself differently according to the angle $\delta$ varying along the circumference. This requirement is fulfilled by designing the upper surface of the seal very narrow, the required minimum width of the pot bearing seal being defined by the above defined play $\Delta d$ between the external diameter of the bearing cap and the internal diameter of the internal pot wall 16. Since this play $\Delta d$ is in the order of about 1 mm and a certain overlapping by the bearing cap 4 must be guaranteed, the width of the seal is about 3 mm. In this case one may proceed from the assumption that the upper lateral surface of the pot bearing seal 8 tilts with respect to the underside of the bearing cap 4 and that thus the cylindrical surface 22 of the pot bearing seal 8 can have a close surface contact with the interal pot wall 16.

Because of the variability of the angle along the circumference the necessary tilt angle of the upper sealing surface, seen along the circumference, is also variable. n order to be able to adjust to such variable tilt angle, the pot bearing seal as a whole must be as torsionally soft as possible. In the case of the embodiment shown in FIGS. 3 to 5 the pot bearing seal 8 is a lamellar seal, i.e. it comprises tandem-joined upright metal laminas 24 which can joined to each other by means of rubber layers 26 vulcanized in between the metal laminas 24. Such a lamellar seal exhibits an excellent mechanical stability and also a high flexibility.

The manufacture of such lamellar seal is outlined in FIG. 5. First of all, an elastomer-metal-block 28 is prepared, which comprises a plurality of parallel steel plates 30 which are joined to each other by means of rubber layers vulcanized into said steel plates. Then, the required separating cuts are made at positions indicated as 32, in order to obtain a lamellar seal 34 of the desired size. The lamellar seal 34 which is still straight-lined at this stage is then formed to a ring, and the adjoining edges are connected to each other in an appropriate manner, optionally with step-like designed ends, so that the steps of both ends overlap each other.

The annular pot bearing seal 8 is then inserted into a circumferential groove 20 which extends along the outer upper edge of the pressure pad 6 and whose dimensions correspond to those of the pot bearing seal 8. Preferably a bent angular piece of high-grade sheet steel may be placed between the vertical wall of the groove of the pressure pad 6 and the internal cylindrical wall of the pot bearing seal 8 in the joint area of the lamellar seal, i.e. where the two ends of the lamellar seal 34 meet each other, in order to cover the joint with respect to the pressure pad.

On the cylindrical outer surface of the pot bearing seal 8 there is fastened, e.g. with adhesive, a strip of abearing foil 36 in order to provide for a good sliding of the pot bearing seal along the internal pot wall 16 without foreign lubrication being required. As shown in FIGS. 3 and 4, the bearing foil 36 may extend a small distance downward beyond the underside of the pot bearing seal, so that the overlapping bearing foil additonally protects the pressure pad 6, into which the circumferential groove 20 for receiving the pot bearing seal 8 has been cut, and whose surface may possibly be slightly damaged in the area of said cut.

The pot bearing seal 8 as a whole has a rectangular crosssection, and in the case of the embodiment described herein it has a width of 3 mm and a height of 10 mm. However, it will be obivous to one skilled in the art that the concrete dimensions of the pot bearing seal may be varied according to the specific case for which it is used. Nevertheless it must be ensured that the width of the pot bearing seal is relatively narrow as compared to the height thereof, so that the torque acting in the direction of the pot wall is larger than the torque occurring about a narrow edge of the seal, in order to ensure that the cylindrical surface 22 of the pot bearing seal 8 abuts the internal pot wall 16 under any operating conditions. In detail, the pressure of the rubber pad acting from the inside to the outside causes a radial displacement r of the sealing ring in the direction of the pot wall. Since the resultant of this radially acting internal pressure acts in the thrust center of the sealing cross-section, this does not lead to a torsion of the crosssection of the sealing ring. However, the radial displacement of the sealing ring against the pot wall, however, will result in a contact pressing which variably extends over the height of the sealing ring and entails a torque about the upper ring edge. Such torque is contrary to the torque which results from the pad pressure acting in an axial direction on the underside of the sealing ring. Further, a torque resulting from the friction between the sealing ring and the pot wall acts about the upper edge of the sealing ring which adjoins the underside of the cap.

I claim:

1. A pot bearing which includes a bearing pot having a cylindrical internal pot wall, a pressure pad mounted within said bearing pot and having a circumferential groove which extends about the upper peripheral edge thereof, a bearing cap including a cylindrical portion which extends within said bearing pot and has a lower portion which abuts against the upper portion of said pressure pad whereby said pressure pad supports said bearing cap, the outer periphery of said cylindrical portion being spaced apart from said cylindrical internal pot wall to provide a gap therebetween, and wherein the tilting of said bearing cap in said bearing pot is allowed by a minimum play of $\Delta d = g \times \sin \alpha$ in which $\Delta d$ corresponds to the difference between the inner diameter of said cylindrical internal pot wall and the outer diameter of the said cylindrical portion of said bearing cap, g is the height of that part of said bearing cap which extends within said bearing pot, and $\alpha$ is the maximum occurring tilt angle of said bearing cap in said bearing pot, and a cylindrical bearing seal mounted within said circumferential groove of said pressure pad, said bearing seal having a peripheral surface for abutment against said cylindrical internal pot wall of said bearing pot and being of a height for engagement of the upper portion thereof with said lower portion of said bearing cap, said bearing seal overlapping said pressure pad and being of a width for sealing off the gap between the outer periphery of said cylindrical portion of said bearing cap when said bearing cap is normal to said bearing pot and when said bearing cap is tilted from the normal of said bearing pot as allowed by a minimum play of $\Delta d = g \times \sin \alpha$.

2. Pot bearing according to claim 1, characterized in that the minimum overlapping is less than 2 mm.

3. Pot bearing according to claim 1, characterized in that the width of gap (18) between the internal pot wall (16) and the bearing cap (4) is about 0.5 to 1.5 mm.

4. Pot bearing according to either of claims 2 or 3, characterized in that the width of the pot bearing seal (8) is smaller than 4 mm.

5. Pot bearing according to claim 1, characterized in that the height of the pot bearing seal (8) is at least three times as large as the width thereof.

6. Pot bearing according to claim 5, characterized in that the height of the pot bearing seal (8) is about 9 to 15 mm.

7. A pot bearing seal as specified in claim 5 characterized in that the pot bearing seal is made of high-grade steel and is provided with a bearing foil at least at its cylindrical surface.

8. Pot bearing according to claim 7, characterized in that the bearing foil (36) is of reinforced PTFE.

9. Pot bearing according to claim 8, characterized in that the bearing foil (36) is reinforced with metal wire cloth.

10. Pot bearing according to claim 8, characterized in that the bearing foil (36) is made of carbon- or glassfiber reinforced PTFE.

11. Pot bearing according to claim 7, characterized in that the bearing foil (36) extends downward beyond the lower outer edge of the circumferential groove (20) of the pressure pad (6) to an extent such that it overlaps said edge.

12. Pot bearing, according to claim 1, characterized in that the annular pot bearing seal (8) is made as a composite body of a sequence of tandem-joined upright metal laminas (24) which are joined to each other by means of rubber layers (26) vulcanized in between the laminas.

* * * * *